US008479746B1

(12) United States Patent
Tannous

(10) Patent No.: US 8,479,746 B1
(45) Date of Patent: Jul. 9, 2013

(54) WATER PIPE STARTER AND CLEANING DEVICE

(76) Inventor: Bishara Tannous, Boynton Beach, FL (US)

( * ) Notice: Subject to any disclaimer, the term of this patent is extended or adjusted under 35 U.S.C. 154(b) by 1588 days.

(21) Appl. No.: 11/786,286

(22) Filed: Apr. 11, 2007

Related U.S. Application Data

(63) Continuation-in-part of application No. 11/430,730, filed on May 9, 2006, now Pat. No. 7,690,076.

(51) Int. Cl.
*A24F 9/04* (2006.01)

(52) U.S. Cl.
USPC ..... 131/243; 15/319; 15/330; 131/244

(58) Field of Classification Search
None
See application file for complete search history.

(56) References Cited

U.S. PATENT DOCUMENTS

| | | | |
|---|---|---|---|
| 1,513,147 | A | 9/1921 | Zahariadis |
| 1,722,595 | A | 7/1929 | Rose |
| 3,363,633 | A | 1/1968 | Weber |
| 3,889,690 | A | 6/1975 | Guarnieri |
| 3,986,516 | A | 10/1976 | Brooks |
| 4,164,230 | A | 8/1979 | Pearlman |
| 4,190,034 | A | 2/1980 | Wonisch |
| 4,193,411 | A | 3/1980 | Faris et al. |
| 4,325,163 | A | 4/1982 | Mattson et al. |
| 4,370,690 | A | 1/1983 | Baker |
| 4,648,410 | A | 3/1987 | Seroussi |
| 4,734,017 | A | 3/1988 | Levin |
| 4,789,310 | A | 12/1988 | Hung |
| 4,810,173 | A | 3/1989 | Thomson et al. |
| 4,916,287 | A | 4/1990 | Soden et al. |
| 5,400,464 | A | 3/1995 | Steiner |
| 5,819,756 | A | 10/1998 | Mielordt |
| 5,920,955 | A | 7/1999 | Berfield |
| 6,284,056 | B1 | 9/2001 | Gonzalez |
| 6,485,276 | B2 | 11/2002 | Yang |
| 6,997,642 | B2 | 2/2006 | Bishop, Jr. |
| 2003/0233730 | A1 | 12/2003 | Sanders et al. |
| 2005/0279371 | A1 | 12/2005 | Billard et al. |

OTHER PUBLICATIONS

Hookah, Wikipedia (W1), Feb. 2006.*

* cited by examiner

*Primary Examiner* — Richard Crispino
*Assistant Examiner* — Phu Nguyen
(74) *Attorney, Agent, or Firm* — Steptoe & Johnson LLP

(57) ABSTRACT

A hookah accessory comprising a motor driven vacuum secured in a housing, vacuum port, filter between the vacuum port and vacuum used to apply a suction force used to ignite and start a hookah, blower port in pneumatic communication with the output/return port of the vacuum to provide a blow force used to clean hoses, switches in the vacuum and air pressure ports to automatically turn on the accessory when inserting a hose, rheostat for adjusting the vacuum suction force, insulated oven having a burner assembly for heating charcoal or other agents used in the hookah and charcoal filter for filtering emissions from the charcoal or heated agent. The invention may have fixed resistors in series with the switches for setting the vacuum at two constant speeds for a set suction force and set air pressure force. The invention may include a basket for placement in the oven.

18 Claims, 14 Drawing Sheets

WATER PIPE STARTER AND CLEANING DEVICE

CROSS REFERENCE TO RELATED APPLICATIONS

This application is a continuation-in-part of application Ser. No. 11/430,730 filed May 9, 2006.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to a water pipe accessory, and more particularly, to a tool for starting and cleaning a water pipe, such as a hookah or shisha pipe.

2. Description of the Background Art

Hookah water pipes, also known as shisha water pipes because of the tobacco typically used, and restaurants providing hookahs are well known worldwide. With reference to FIGS. 1 and 2, a hookah 1 is a water pipe having a tobacco reservoir/bowl 3, such as for shisha or other soaked tobacco, in fluid/pneumatic communication with a tobacco smoke feed tube 4 that depends into a smoke chamber 5, which is partially filled with water, and one or more hoses 2 releasably attached to the water pipe 1 in fluid/pneumatic communication with the smoke chamber 5 for drawing air/oxygen and resulting smoke from the tobacco through one or more hoses. Perforated foil is typically placed over the tobacco product and bowl for holding independently heated charcoal used to reduce harshness and accelerate ignition of the tobacco. Notwithstanding, starting the hookah 1 so it ignites and remains ignited can be very difficult and time consuming. The difficulty arises because shisha comprises tobacco(s) that are flavored with moist additives, such as molasses, making it difficult to properly and efficiently ignite the tobacco and start the hookah. This problem is exasperated by the build-up of residue in the hoses, which also causes odors. Accordingly, restaurants, cafes and the like providing hookahs typically ignite the tobacco for patrons and must clean the hookah and hoses. Unfortunately, they confront the same obstacles, which adversely affects customer service and hence the success of the restaurant. Conventional hookahs also present health problems associated with inhaling particulate matter/debris and restaurant employees placing their mouth on the hose to ignite the hookah tobacco. If there existed a water pipe accessory that could start and ignite the hookah 1 as well as clean its hoses 2 it would eliminate problems associated with starting and cleaning a hookah and save servers valuable time while making the patron's visit to the hookah restaurant more enjoyable. However, there are no known devices that can provide the dual functions of starting a hookah or other water pipe and cleaning hoses. If such a device existed it would be well received.

Although various pipes and smoking accessories are shown in the background art, they fail to disclose a device or system that adequately addresses or resolves the above-noted gaps in the prior art. The background art known fails to disclose a hookah or water pipe accessory that can start the pipe and clean its hoses to facilitate an easier draw, increase sanitary conditions and reduce or eliminate odors. For instance, U.S. Pat. No. 1,531,147, issued to Zahariadis, discloses a water pipe. U.S. Pat. No. 3,363,633, issued to Weber, discloses a battery-operated blower for keeping a non-water pipe lit. U.S. Pat. No. 3,889,690, issued to Guarnieri, discloses a water pipe having a flame igniter or electrical resistance element. U.S. Pat. No. 4,164,230, issued to Pearlman, discloses an automatic non-water smoking pipe including a fan. U.S. Pat. No. 4,190,034, issued to Wonisch, discloses a hand-held apparatus for starting and fanning a fire, such as in a fire place, by providing a source of fuel and air. U.S. Pat. No. 4,193,411, issued to Faris, discloses a power-operated non-water pipe comprising a removable cup for holding tobacco, a fan and an air chamber for drawing air from the bowl with the fan, disclose a perforator designed for use with only one cigar or cigarette. U.S. Pat. No. 4,648,410, issued to Seroussi, discloses a nargile water pipe for smoking cured tobaccos. U.S. Pat. No. 4,734,017, issued to Levin, discloses a hand-held air blower with a rechargeable power supply that may be used for supplying air to a fire in a grill or fireplace. U.S. Pat. No. 4,810,173, issued to Thomson, discloses a portable air blower with an elongated hollow extension sleeve to guide forced air directly onto fire. U.S. Pat. No. 5,819,756, issued to Mielordt, discloses a device for smoking tobacco or other products. U.S. Pat. No. 6,284,056, issued to Billard, discloses a composition useful for removal of organic deposits from a ceramic, glass, plastic or metal substrate.

Based on the foregoing, the prior art discloses various pipes and devices but fails to disclose an accessory that can be used with any hookah or other comparable water pipe to properly ignite the tobacco in the water pipe, clean the pipe's hose(s) and, or heat charcoal. Accordingly, there exists a need for such an accessory. The instant invention addresses this unfulfilled need in the prior art by providing a water pipe starter and cleaning accessory as contemplated by the instant invention disclosed herein.

BRIEF SUMMARY OF THE INVENTION

In light of the foregoing, it is an object of the present invention to provide a hookah accessory that accelerates and simplifies the ignition of shisha, or other tobacco, when starting a hookah.

It is an object of the instant invention to provide a hookah accessory that provides a suction force and access to the suction force for drawing air through the hookah tobacco and resulting smoke through the hose.

It is also an object of the instant invention to provide a hookah accessory that provides an adjustable suction force for drawing air through the hookah tobacco and resulting smoke through the hose.

It is a further object of the instant invention to provide a hookah accessory that provides air pressure for cleaning hookah hoses to remove particulates in the hose and clear resonating odors.

It is another object of the instant invention to provide a hookah accessory that can be used to clean and dry the hookah/water-pipe body.

It is an additional object of the instant invention to provide a hookah accessory that improves health conditions by eliminating the need for restaurant employees or customers to place their mouth on the hose when starting the hookah.

It is an object of the instant invention to provide a hookah accessory having an oven means that can heat charcoal or other selected heating agents used to preheat shisha or other tobacco.

It is yet another object of the instant invention to provide a hookah accessory that thermally insulates the oven used for heating charcoal or other selected heating agents from surrounding components.

It is yet an additional object of the instant invention to provide a hookah accessory that can adjust the power of the vacuum source used to start the hookah.

It is still another object of the instant invention to provide a hookah accessory that filters and exhausts charcoal emissions.

It is still an additional object of the instant invention to provide a hookah accessory that can transform 220 VAC, or the like, to 110/120 VAC, or the like, for facilitating use of the instant invention worldwide.

It is another object of the instant invention to provide a hookah accessory having light sources that are individually illuminated to indicate certain operations or conditions of the hookah accessory.

It is yet another object of the instant invention to provide a hookah accessory that extends the life of hookah hoses.

It is yet a further object of the instant invention to provide a hookah accessory is that cost-effective.

It is yet an additional object of the instant invention to provide a hookah accessory that is easy and convenient to use.

In light of these and other objects, the instant invention comprises a hookah accessory that provides a suction force to start hookahs and air pressure force to clean debris from hookah hoses to make for an easier draw, remove odors and improve health conditions, clean hookah bodies and dry hookahs and hoses. The instant invention also improves health and sanitation conditions by eliminating the need for restaurant employees or customers to make mouth contact with the pipe hose. The hookah accessory comprises a motor driven vacuum secured in a housing, vacuum port, filter between the vacuum port and vacuum, blower port in pneumatic communication with the output/return port of the vacuum and variable resistor (rheostat) to adjust the vacuum suction force. The filter is in line with the vacuum port and vacuum to capture debris before it reaches the vacuum or vacuum motor. The vacuum and blower ports preferably comprise pliable rubber ends for universal use in securely receiving and holding different sized hoses and, or hose tips. Switches are preferably disposed in the vacuum and blower ports, which turns on the hookah accessory motor when a hose is inserted and turns it off when removed. Alternatively, switches may be positioned for manual actuation. The suction or blowing forces may be preset so the accessory turns on at the appropriate level of suction and, or pressure. The instant invention may also include hoses adapted for use with a hookah and the hookah accessory. The preferred hose has at least one tapered end or tip for an airtight seal when inserted in a port and, or hookah.

In the preferred embodiment, the instant invention may comprise a number of other features. The hookah accessory may include a oven having a burner for heating charcoal or other heating agents that may be used to ignite the tobacco product. The oven is thermally insulated and aligned with a filtered vent for filtering charcoal emissions. The instant invention may include a high-heat thermo basket for holding charcoal or similar heating agents over the burner. The charcoal filter is preferably incorporated above the burner section in an exhaust port to filter emissions from the charcoal or other heating agent. The hookah accessory may include a timer for removing power from the burner after a predetermined or selected period of time, such as four to eight minutes. As the instant invention has worldwide appeal, the hookah accessory should include a power transformer that converts a 220 VAC power source, or the like, to approximately 110/120 VAC or other power level required for operating the hookah accessory. In one embodiment, this power conversion may be selectively activated or deactivated. The hookah accessory may include various sensors and timers. The hookah accessory may include a burner sensor and timer and, or temperature sensor and timer. The burner sensor and timer indicates whether the burner is on or off and removes power from the burner after a predetermined period of time. The system temperature sensor indicates when the hookah accessory exceeds a predetermined temperature threshold and the temperature timer removes power when the temperature exceeds the temperature threshold. The hookah accessory may include LED indicators, or comparable indicators, in electrical communication with the burner sensor, temperature sensor and other incorporated sensors, such as an air filter sensor and, or smoke filter sensor, that are illuminated to indicate certain settings, conditions or requirements upon preset thresholds.

To use the hookah accessory for starting a hookah, the burner is turned on, charcoal is placed in the basket and the basket is placed on the burner. Once the charcoal is heated it is placed in the hookah below the tobacco reservoir to heat the tobacco. When the hookah is ready to be used, the hose is placed in the vacuum port, activating the vacuum and vacuum motor. The suction force may be increased or decreased by adjusting the rheostat setting. A low suction force is preferred for starting the hookah. While the vacuum is running, fire is applied to the tobacco to ignite it. The suction force provided by the vacuum draws air and smoke through the tobacco causing the fire to ignite it more quickly then without the suction force. Once ignited, the hose is removed from the vacuum port, which de-activates the vacuum.

To use the hookah accessory to clean a hookah and, or hose, the hose is first removed from the hookah. The hose tip is then inserted into the blower port, which activates the vacuum and vacuum motor creating an air pressure source in the vacuum return port. Once the hookah accessory is energized, air is blown out through the blower port and through the hose forcing out debris and odor. The blow force may be increased or decreased by adjusting the rheostat. Once clean, the hose may be reconnected to the hookah. This feature may also be used to clean other parts of the hookah.

In accordance with these and other objects, which will become apparent hereinafter, the instant invention will now be described with particular reference to the accompanying drawings.

DETAILED DESCRIPTION OF THE INVENTION

Figure 1:
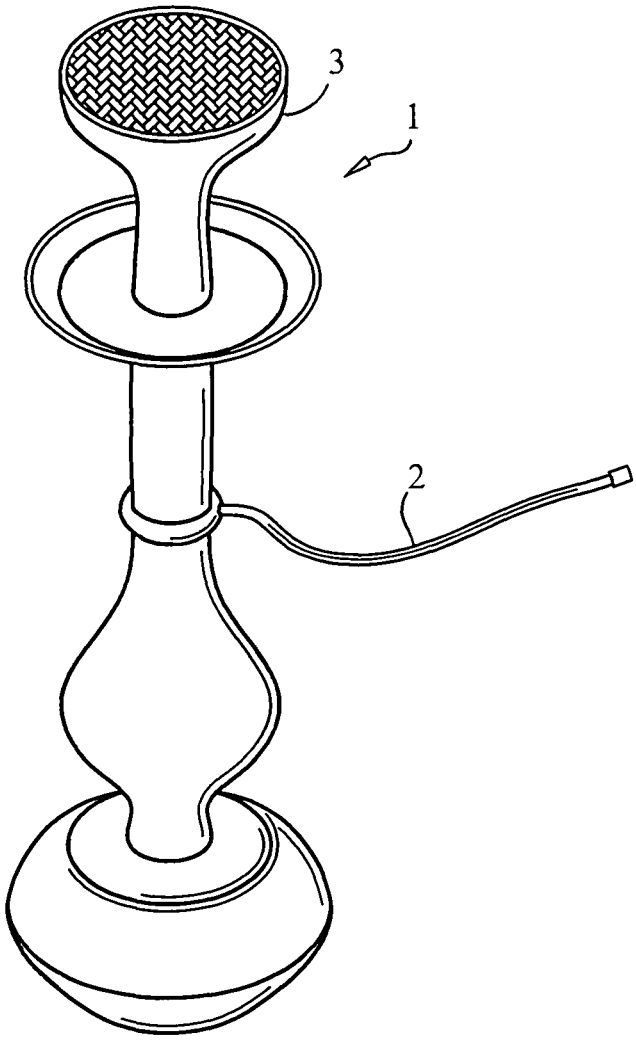
FIG. 1 is a partial perspective view of a hookah generally depicting hookahs known in the prior art that may be used with the hookah accessory of the instant invention.
Figure 2:
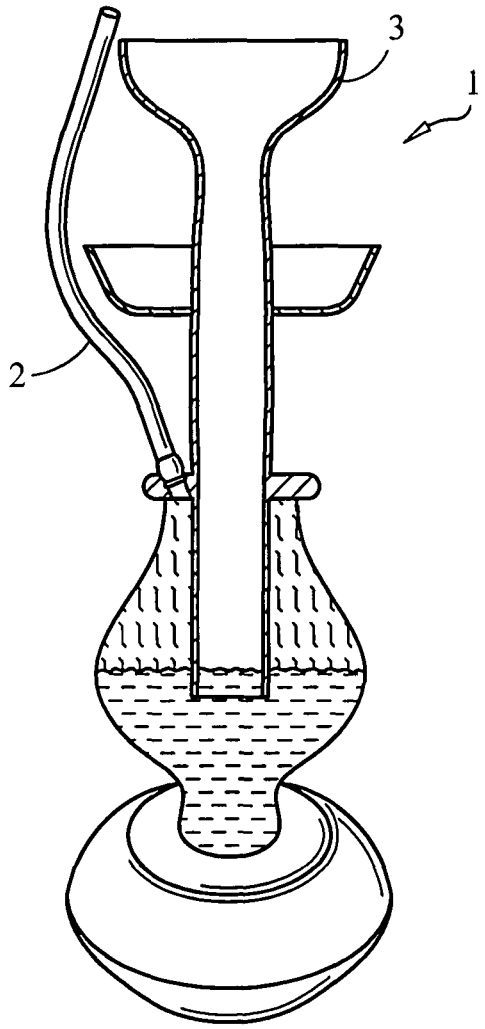
FIG. 2 is a partial cross-sectional view of the hookah shown in FIG. 1.
Figure 3:
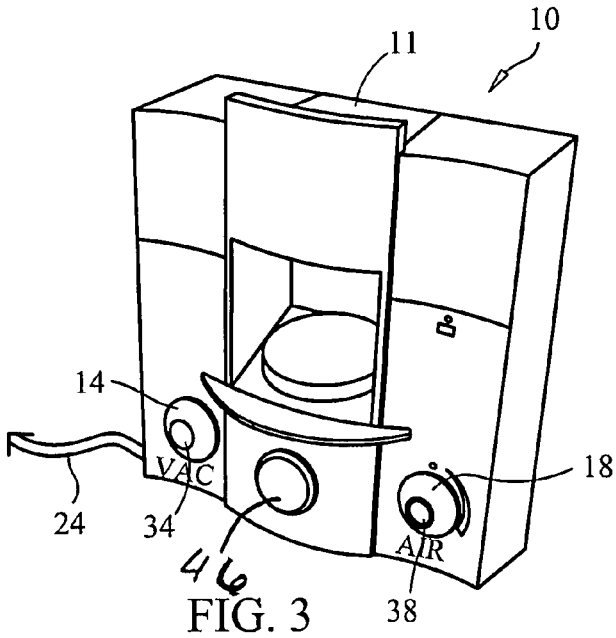
FIG. 3 is a perspective view of the baseline embodiment of the hookah accessory in accordance with the instant invention.
Figure 4:
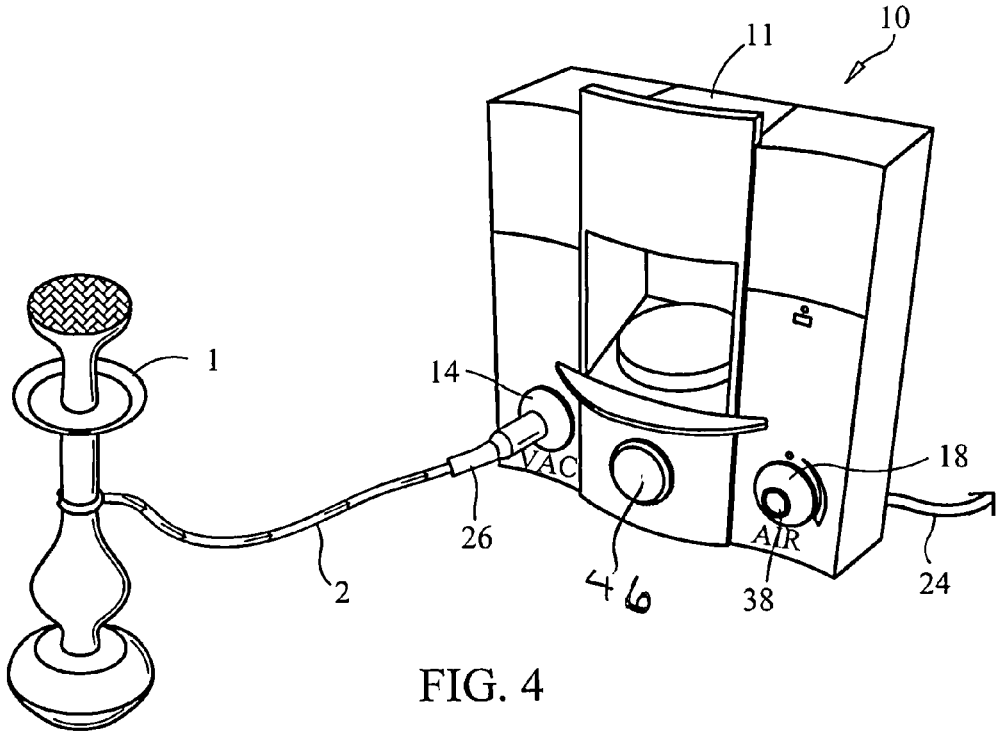
FIG. 4 is a perspective view of the baseline embodiment of the hookah accessory and a hookah connected to the vacuum port of the hookah accessory in accordance with the instant invention.
Figure 5:
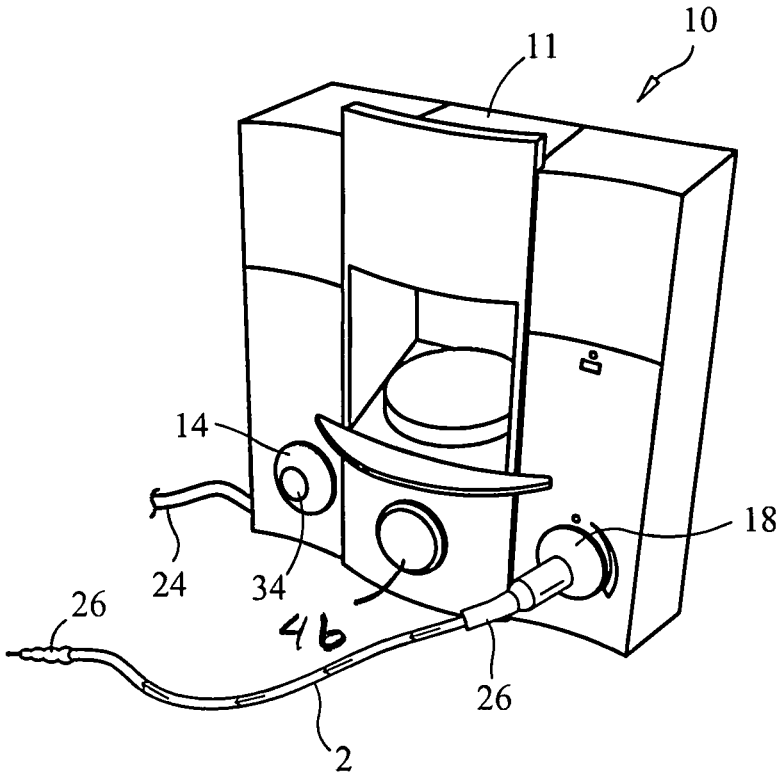
FIG. 5 is a perspective view of the baseline embodiment of the hookah accessory and a hookah connected to the blower port of the hookah accessory in accordance with the instant invention.
Figure 6:
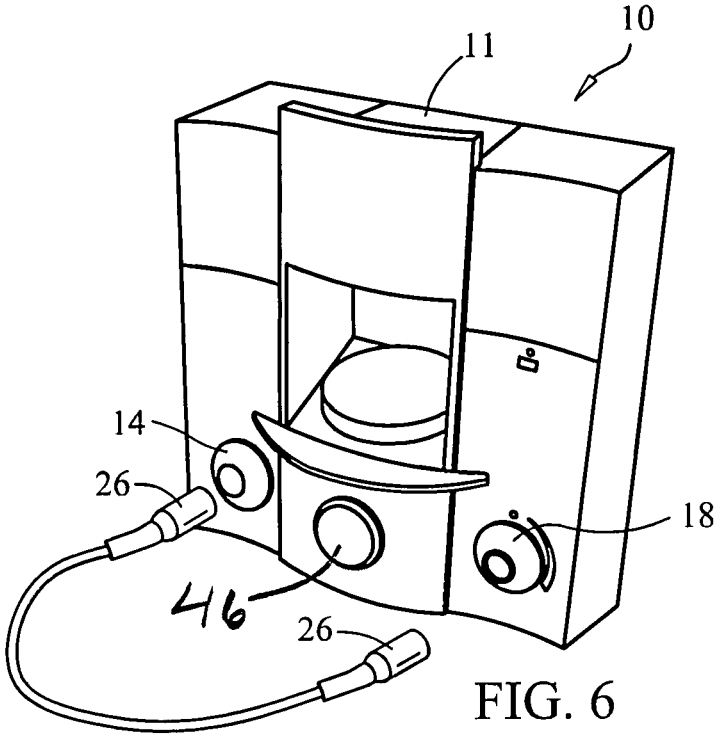
FIG. 6 is a perspective view of an embodiment of the hookah accessory having a motor speed adjustment knob and central switch in accordance with the instant invention.

With reference to the drawings, FIGS. 3 to 19 depict the preferred and alternative embodiments of the instant invention, generally referenced as a hookah accessory and, or by numeric character 10. The hookah accessory 10 is used for igniting and starting water pipes, such as hookahs 1, with a vacuum driven suction force and for cleaning water pipe hoses and, or water pipes with pressurized air generated by the vacuum and exhausted from the vacuum return. The hookah accessory 10 provides an option to manually igniting and starting a hookah and provides a tool for cleaning hookah hoses and hookahs.

With reference to FIGS. 1-19, the preferred and alternative embodiments of the hookah accessory 10 of the instant invention comprise a vacuum 12, wherein a motor 13 is electrically communicated or integrally combined with the vacuum 12, as is known in the art (individually and, or jointly referenced as vacuum-motor 12/13 or similar corresponding variations thereof); housing 11 having an air-pressure/blower bay 17 with an air pressure port 18 pneumatically communicated with the return port of the vacuum 12 and adapted for connecting a hose 2 to provide access to the air pressure for cleaning hoses and/or other hookah parts; vacuum bay 13 with a vacuum port 14 pneumatically communicated with the input/suction port of the vacuum 12 and adapted for connecting a hose 2 to provide access to the vacuum generated suction force for drawing air and heat through the hookah's shisha/tobacco and hose for starting and smoking the hookah; and center bay 15 having an oven system 41 thermally insulated by an insulation layer 70 from the blower and vacuum bays 17, 13 and other heat sensitive components and designed for heating charcoal or comparable heating agents used to preheat the shisha/tobacco. The vacuum port 14 is in fluid/pneumatic communication with the suction source of the vacuum 12 so as to provide access to the suction force generated by the vacuum 12 and for receiving and securing a hose 2 used to start the hookah 1.

Figure 9:
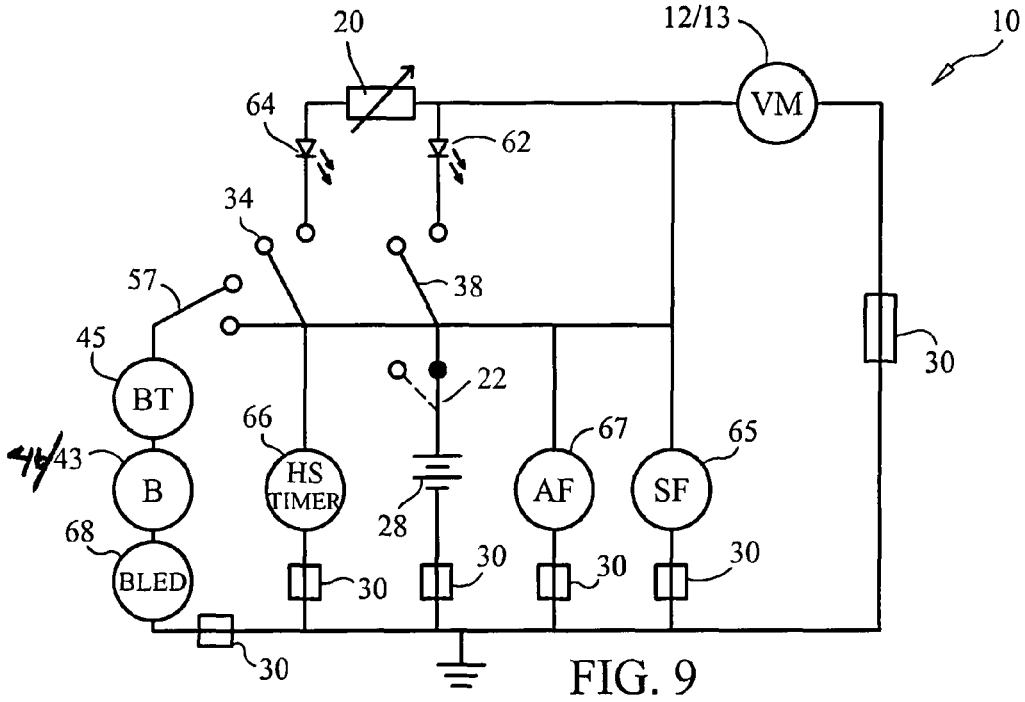
FIG. 9 is an electrical circuit diagram of the preferred embodiment of the hookah accessory adapted for DC power and having a rheostat for incrementally adjusting the vacuum suction force in accordance with the instant invention.
Figure 10:
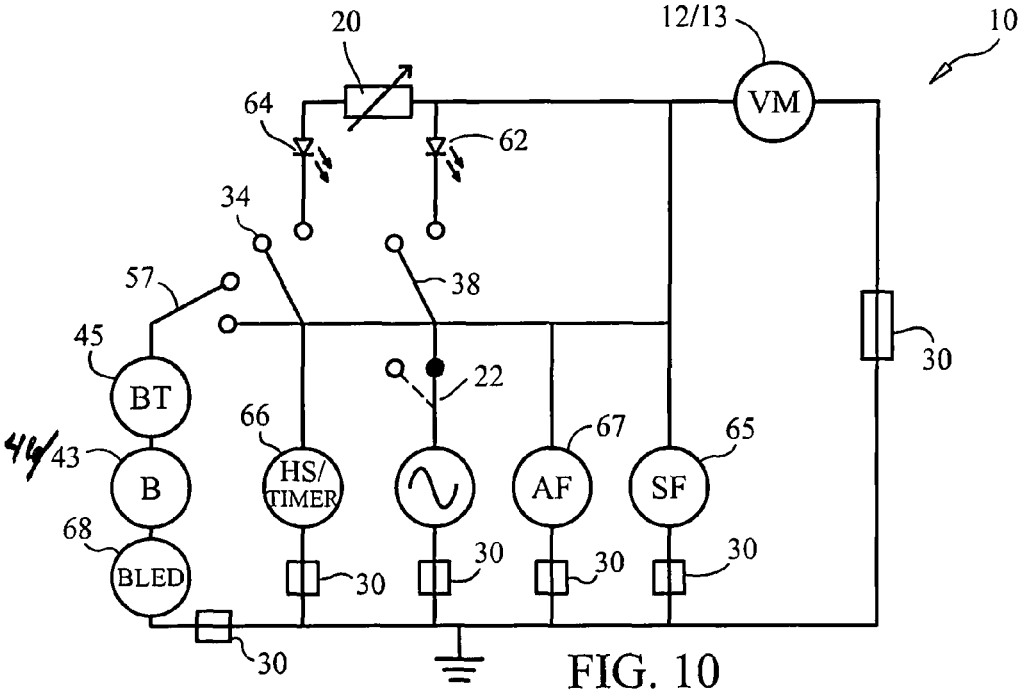
FIG. 10 is an electrical circuit diagram of the preferred embodiment of the hookah accessory adapted for AC power and having a rheostat for incrementally adjusting the vacuum suction force in accordance with the instant invention.
Figure 11:
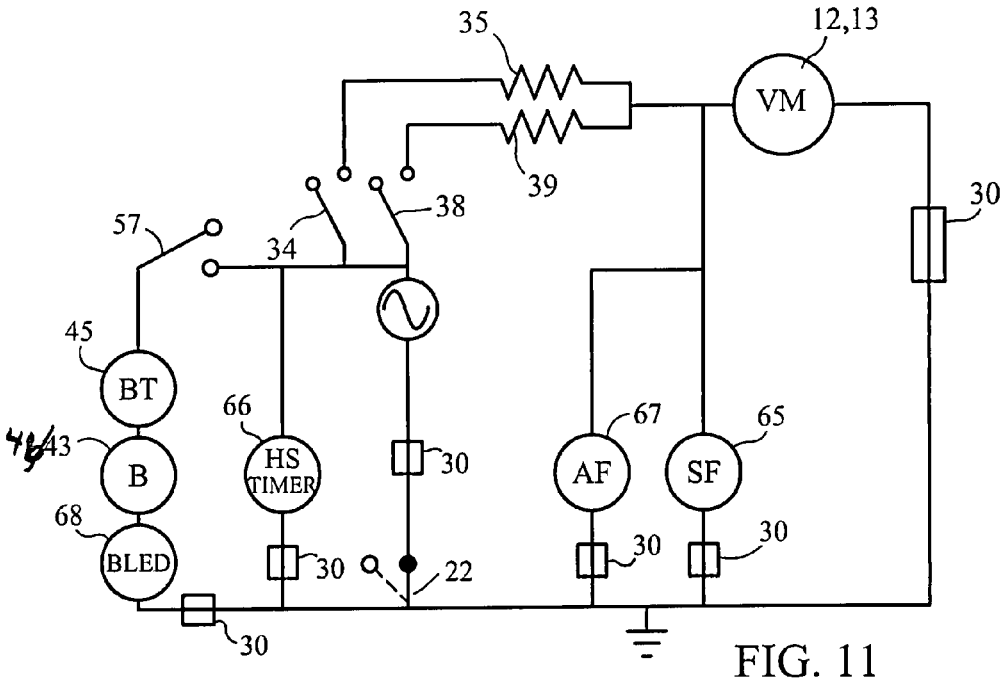
FIG. 11 is an electrical circuit diagram of an alternative embodiment of the hookah accessory adapted for AC power and having a fixed setting for the vacuum force and a fixed setting for air pressure in accordance with the instant invention.
Figure 12:
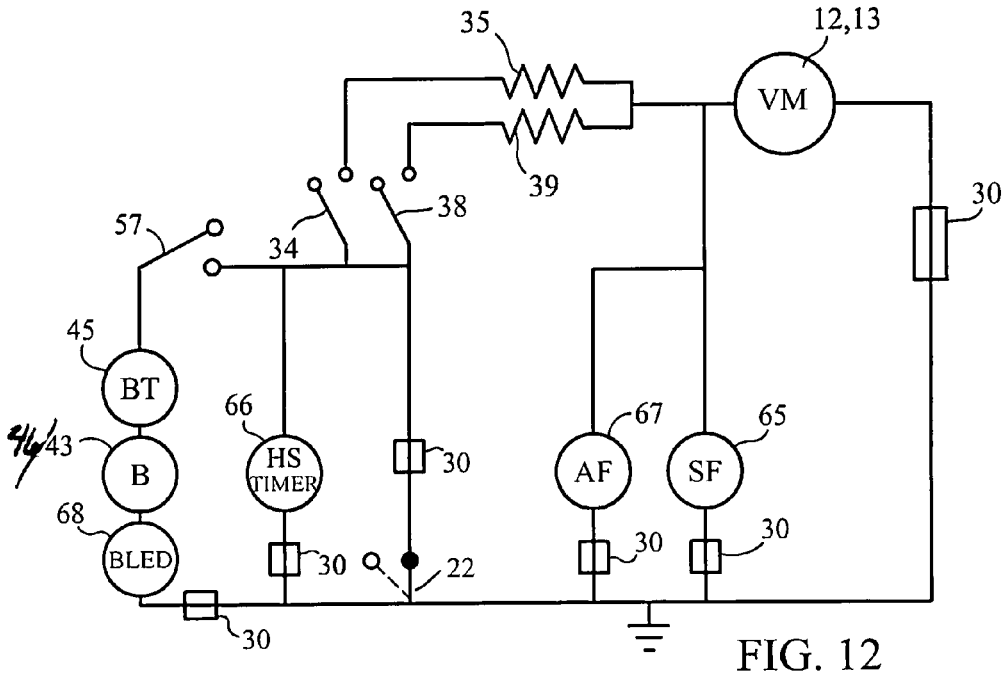
FIG. 12 is an electrical circuit diagram of an alternative embodiment of the hookah accessory adapted for DC power and having a fixed setting for the vacuum force and a fixed setting for air pressure in accordance with the instant invention.
Figure 13:
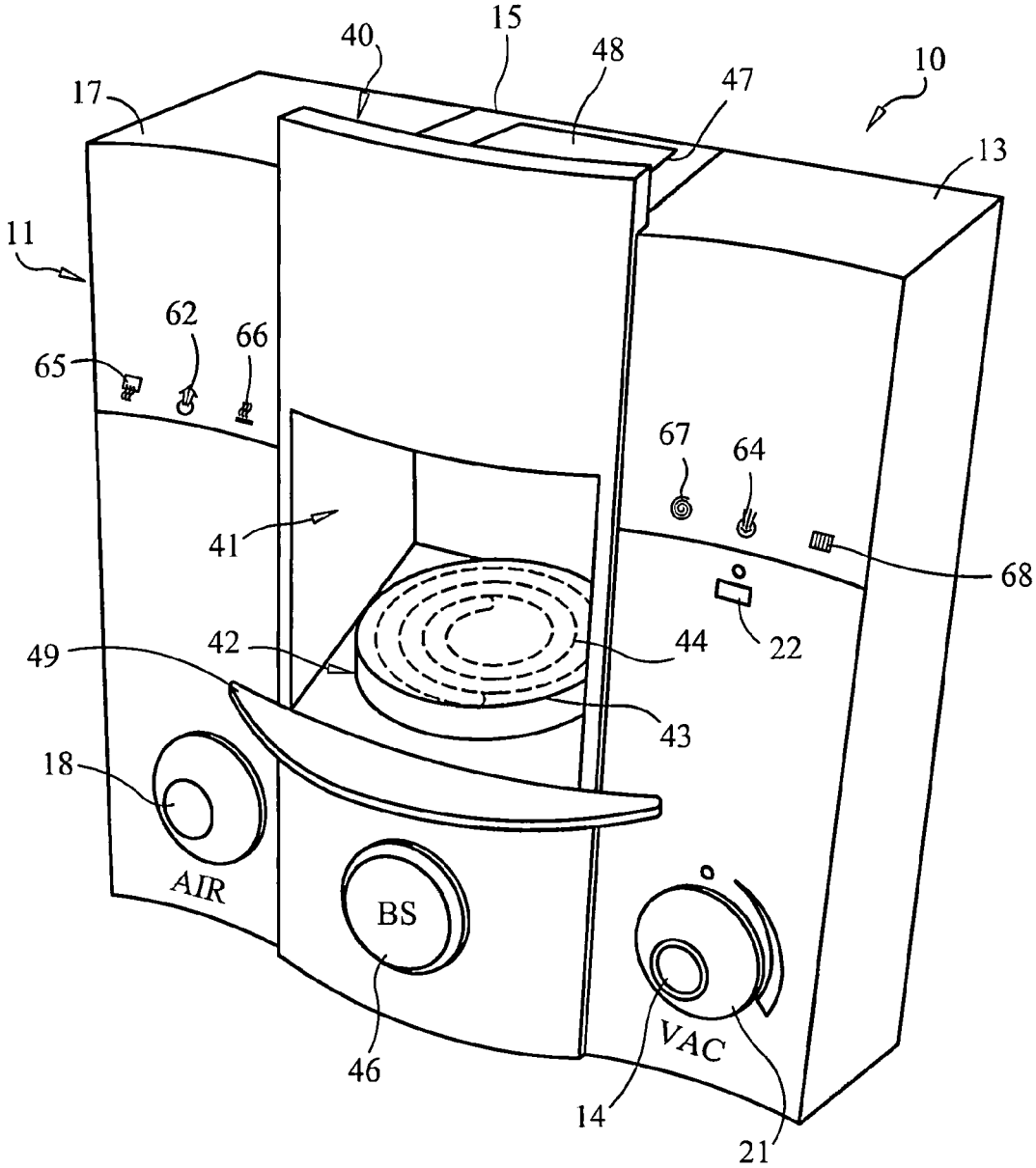
FIG. 13 is a perspective view of the preferred embodiment of the hookah accessory having a burner, charcoal filter, air filter sensor, smoke filter sensor, hot machine sensor and burner LED in accordance with the instant invention.

Referring to FIGS. 9 and 10, a rheostat 20 is preferably electrically coupled between the vacuum switch 34 and vacuum/motor 12/13 for incrementally adjusting the generated suction force. With reference to FIGS. 11 and 12, the suction and air pressure forces may be individually fixed by resistors 35, 39, respectively. In either embodiment, an air filter 16 is preferably securely positioned between the vacuum port 14 and vacuum 12 to capture debris before it reaches the vacuum 12 or vacuum motor 13. The air pressure port 18 is in fluid/pneumatic communication with the output/return port of the vacuum 12 for tapping, directing and providing access to pressurized air from the vacuum 12 used to clean a hose 2, hoses 2 and, or the hookah 1. The vacuum port switch 34 is at least partially disposed in the vacuum port 14 such that it is actuated when inserting or removing a hose or hose tip to automatically and respectively provide and remove power to and from the vacuum-motor 12/13. The air pressure switch 38 is at least partially disposed in the air pressure port 18 such that it is actuated when inserting or removing a hose or hose tip 26 to automatically and respectively provide and remove power supplied to the vacuum-motor 13.

With reference to FIGS. 1-19, the vacuum and blower ports 14, 18 preferably comprise pliable and durable rubber ends that universally adapt to the dimensions of different size hoses or hose tips to substantially provide an air tight seal between the hose/hose-tip and port 14/18. The vacuum and air pressure ports 14, 18 are preferably tapered inward to further facilitate an air tight connection with the hose tips 26. The instant invention 10 may also comprise a main power switch 22 for facilitating the selective application and removal of DC or AC power. The air filter 16 may comprise pleated panel filters, such as the AmAir® 300X or HT sold by AmericanAirFilter® or comparable substitutes known in the art. The charcoal filter 47 preferably comprises an activated carbon cloth metal mesh.

With reference to FIGS. 3-19, the preferred embodiments of the hookah accessory 10 comprise a housing 11 having a center bay 15 and opposing side bays 13, 17 thermally insulated by insulation 70 from the center bay 15. The center bay 15 comprises a steel enclosure 41 for the burner assembly 42 and exhaust chute 51 that is thermally insulated from the side bays 13, 17 by the insulation layer 70. The burner assembly 42 comprises a ceramic cover or plate 43 and heating coil 44 disposed below the plate 43 in electrical communication with the device or source that facilitates access to available power such that it can be used for safely heating charcoal or other heat agents within the oven 41. The vacuum source bay 13 is disposed on one side of the center bay 15 and comprises the vacuum port 14, which is in pneumatic communication with the vacuum suction source. The air-pressure/blower bay 17 is disposed on an opposite side of the center bay 15 and comprises the air pressure port 18, which is in pneumatic communication with the vacuum return port of the vacuum 12, i.e. air pressure port, which is used for cleaning. The heat insulation 70 surrounds and thermally insulates the oven 41 from the side bays 13, 17 and other components in the housing 11, and may at least partially surround the other portions of the center bay 15 so as to thermally separate the center bay 15 from the side bays 13, 17, respectively. The exhaust port 51 is in fluid communication with the oven 41, i.e. burner assembly, and comprises a charcoal filter 47 and grid 48 secured in the exhaust port for filtering emissions therefrom. The charcoal filter 47 preferably comprises an activated carbon cloth, or comparable substitute, that is placed above the burner assembly 42-43 in the exhaust chute 51 and protected by the vented cover 48, to filter emissions from the charcoal or other heating agent. The accessory 10 also preferably comprises a rheostat 20 electrically positioned in series with the vacuum switch 34 for adjusting the vacuum suction force by controlling the current draw to the vacuum-motor 12/13; and plurality of fuses 30.

Figure 14:
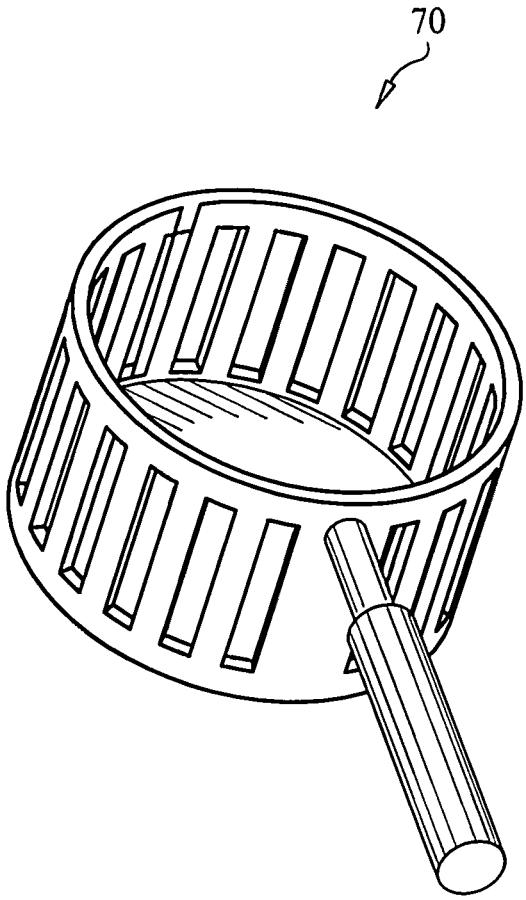
FIG. 14 is a perspective view of the charcoal heating basket in accordance with the instant invention.
Figure 15:
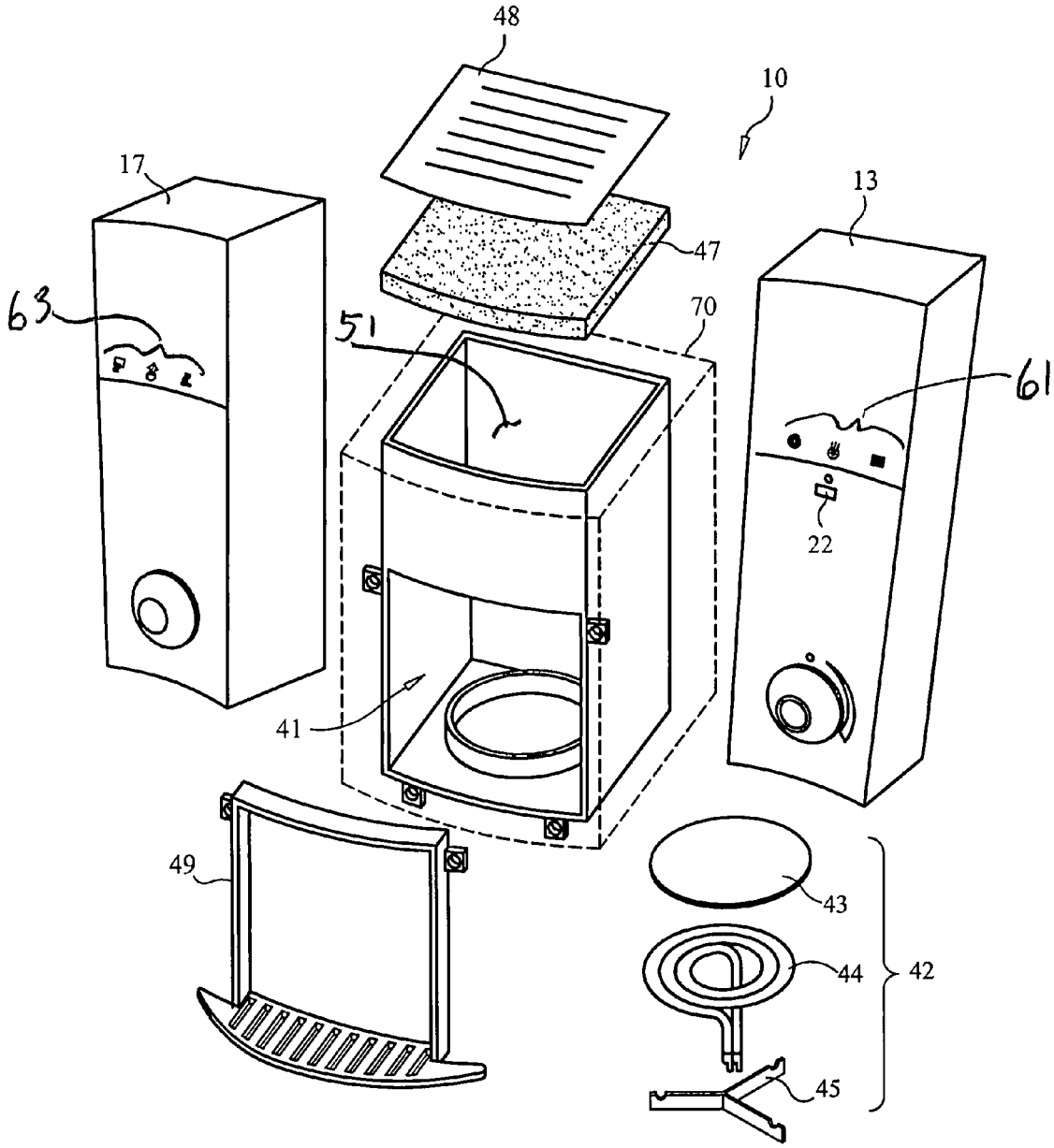
FIG. 15 is a perspective view of the preferred embodiment of the hookah accessory having a burner, charcoal filter, air filter sensor, smoke filter sensor, hot machine sensor and burner LED in accordance with the instant invention.
Figure 16:
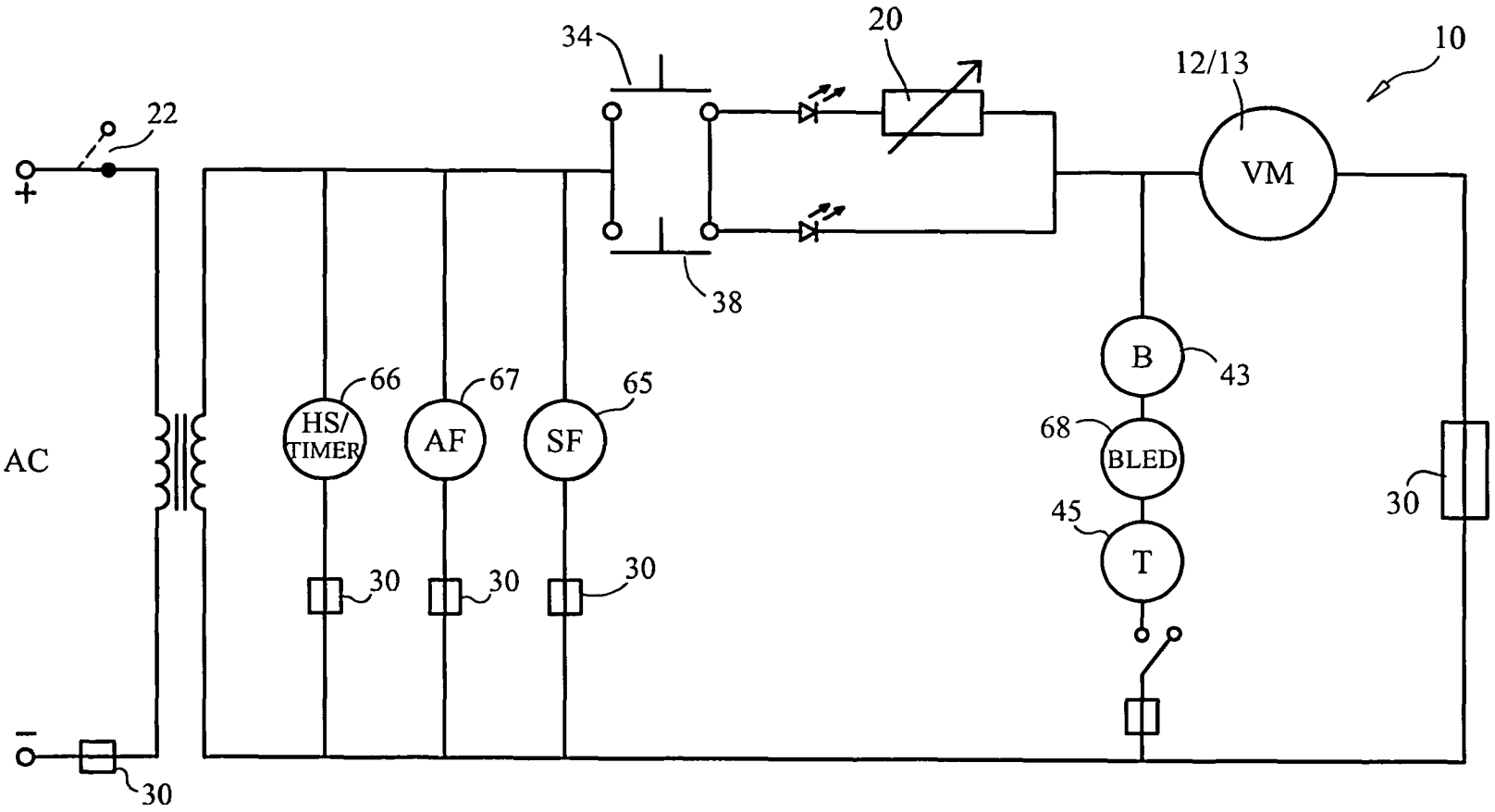
FIG. 16 is an electrical circuit diagram of the preferred embodiment of the hookah accessory having a power transformer for converting high AC voltage (e.g. 220 VAC) to low AC voltage (e.g. 110 VAC) and showing the various sensors and LED's in accordance with the instant invention.
Figure 17:
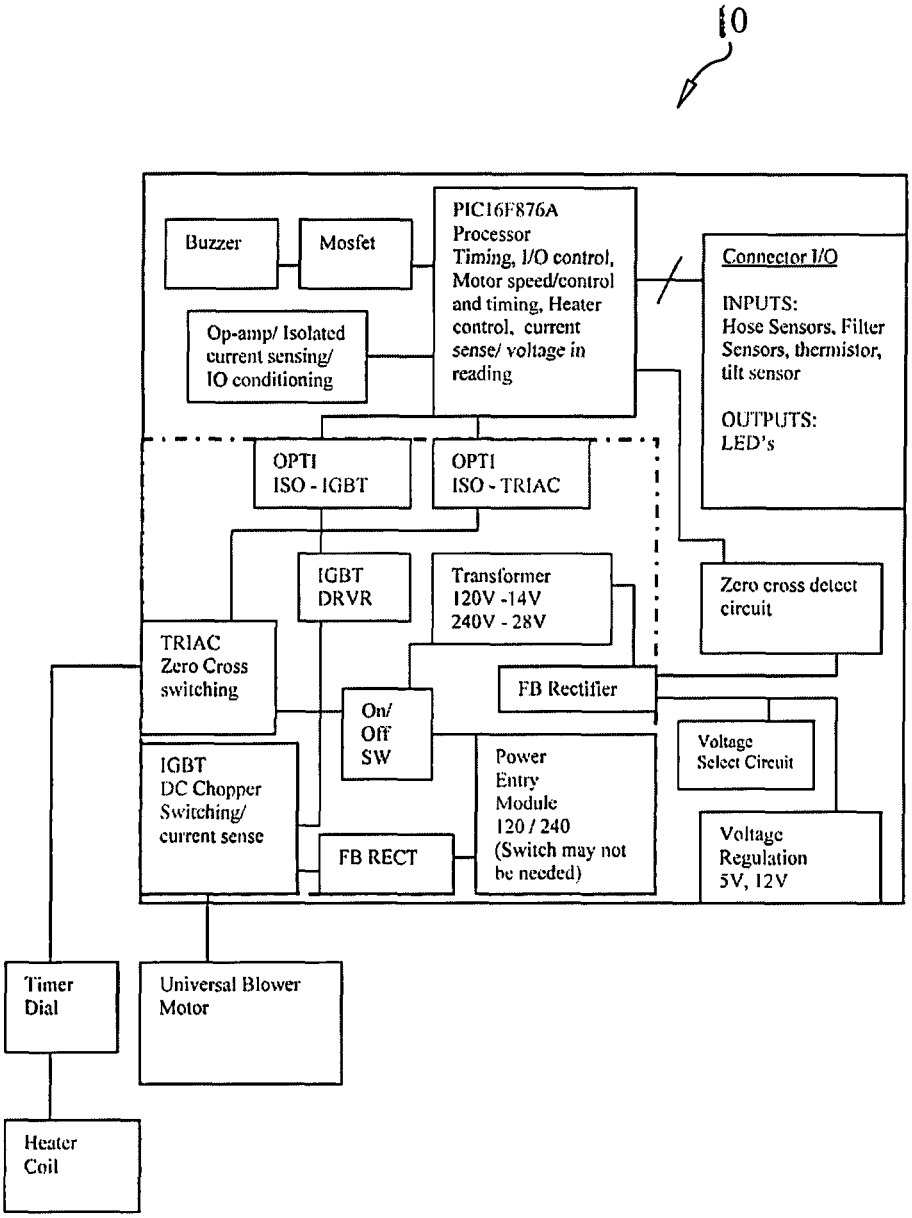
FIG. 17 is a block diagram of the electronics of the preferred embodiment of the hookah accessory in accordance with the instant invention.
Figure 18:
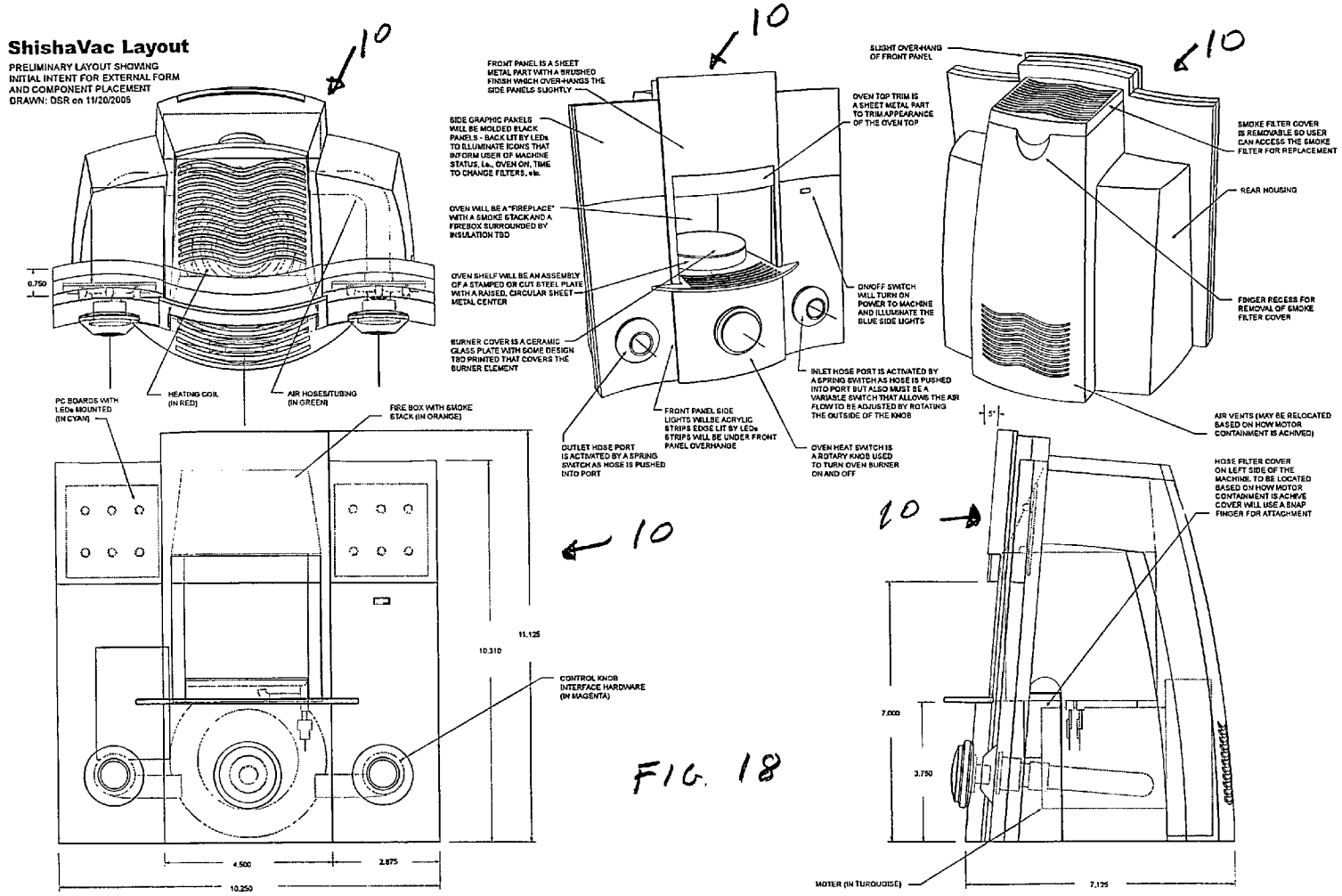
FIG. 18 shows perspective views of the preferred embodiment of the hookah accessory in accordance with the instant invention.
Figure 19:
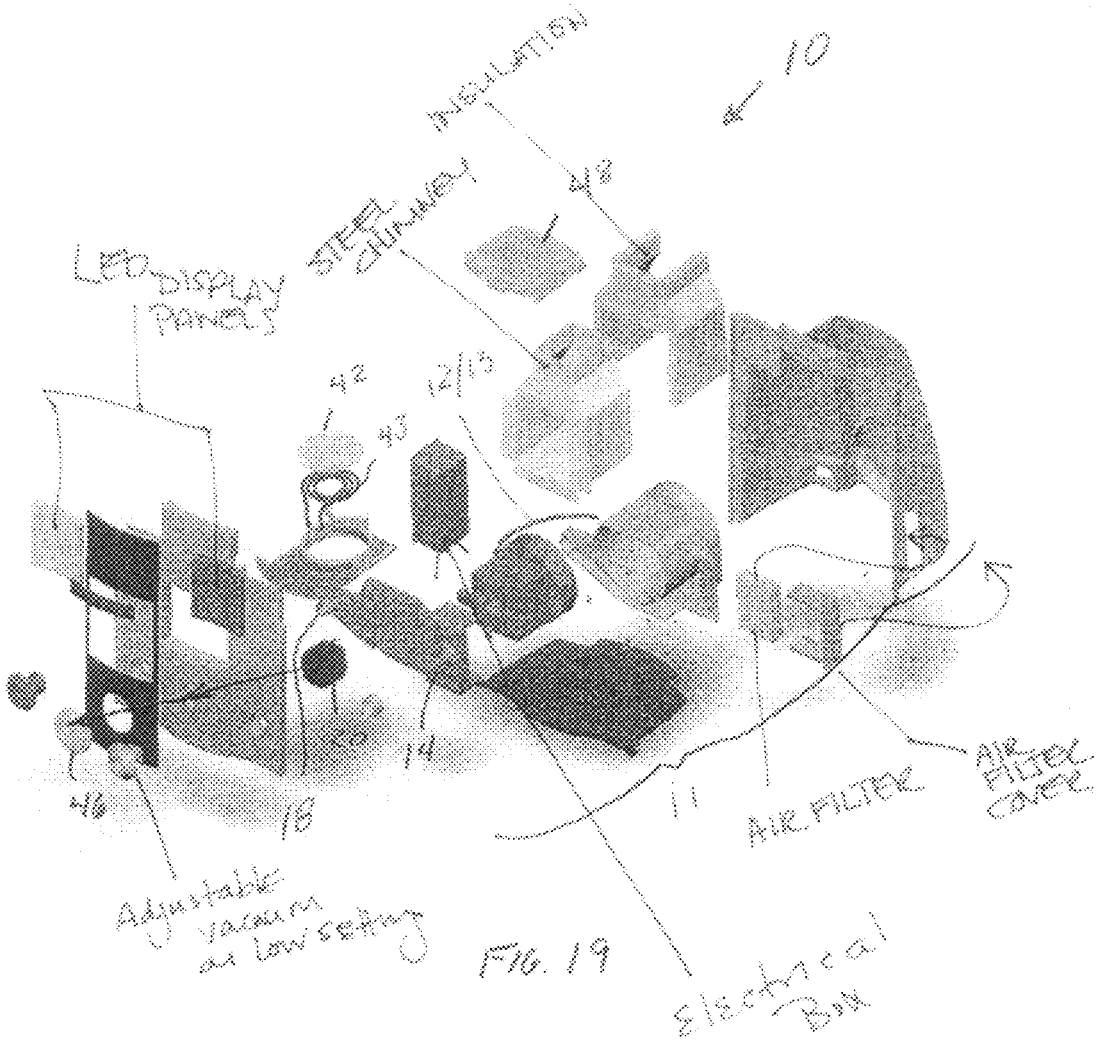
FIG. 19 is an exploded perspective view of the preferred embodiment of the hookah accessory in accordance with the instant invention.

The burner assembly 42-43 comprises an electrical coil burner element 43 covered by a ceramic/glass cover 42 on to which a basket 70 containing charcoal or other heating agent (s) is placed to heat the contents. The burner assembly 42 may be electrically connected to an LED 68 or comparable indicator that is activated when the burner switch 46 is actuated to power. The burner 43 may be electrically coupled to a timer 45 that automatically removes power from the burner 43 after a predetermined or selected period of time, such as four to eight minutes. The coil burner 43 timing is set by an adjustable switch 46 that may be adjusted for a half filled basket 70 of charcoal, such as 4-8 minutes, or full basket of charcoal 70, such as 8-10 minutes, by adjusting the knob 46 to corresponding indicators. The coil burner 43 timing may be designed to accommodate smaller increments. The instant invention 10 may include a high-heat thermo basket 70 for holding charcoal or similar heating agents over the burner, as shown in FIG. 14, to heat the contents. The preferred embodiment of the hookah accessory 10 may comprise a smoke filter-LED assembly 65 and air filter-LED assembly 67, which sense and indicate when a filter 65 or 67 or the filters 65, 67, respectively, should be changed.

The preferred embodiment of the instant invention 10 comprises a variety of sensors/timers 65-67, LED's (such as 65-68) and plurality of fuses denoted by numeric character 30. The rheostat 20 is connected in series with the vacuum switch 34 for incrementally adjusting the current to the vacuum motor 12/13 and hence the suction force. The rheostat 20 is adjusted by actuating the collar 21 circumventing the vacuum port 14. The preferred embodiment of the instant invention 10 further comprises a vacuum LED 64, air pressure-blower LED 62, smoke filter 65

With reference to FIGS. 11 and 12, an alternative embodiment of the instant invention 10 comprises preset power levels for the vacuum force and air pressure, respectively. When applying power, the vacuum 12 and, or vacuum motor 13 is preferably turned on at a preset power level based on which switch is actuated, i.e. vacuum switch 34 or air switch 38. The vacuum resistor 35 and air pressure resistor 39 provide a means for adjusting the power of the suction and air pressure forces generated by the vacuum 12 depending on which switch 34, 38 is triggered. The first/vacuum resistor 35 has a predetermined Ohm level, which fixes the amount of current to the vacuum motor 12/13 and hence the motor speed and suction force. The second/air resistor 38 has a predetermined Ohm level, which fixes the amount of current to the vacuum motor 12/13 and hence the motor speed and air pressure force tapped from the vacuum return port 18. When a hose tip 26 is inserted in the vacuum port 14, the vacuum switch 34 is actuated connecting the power source 28 or 29 and vacuum resistor 35 in series with the vacuum motor 13. When a hose tip 26 is inserted in the air pressure port 18, the air pressure switch 38 is actuated connecting the power source 28 or 29 and air pressure resistor 39 in series with the vacuum motor 13 The switches 34, 38 may be momentary push switches, toggle switches or similar switches known in the art.

Figure 7:
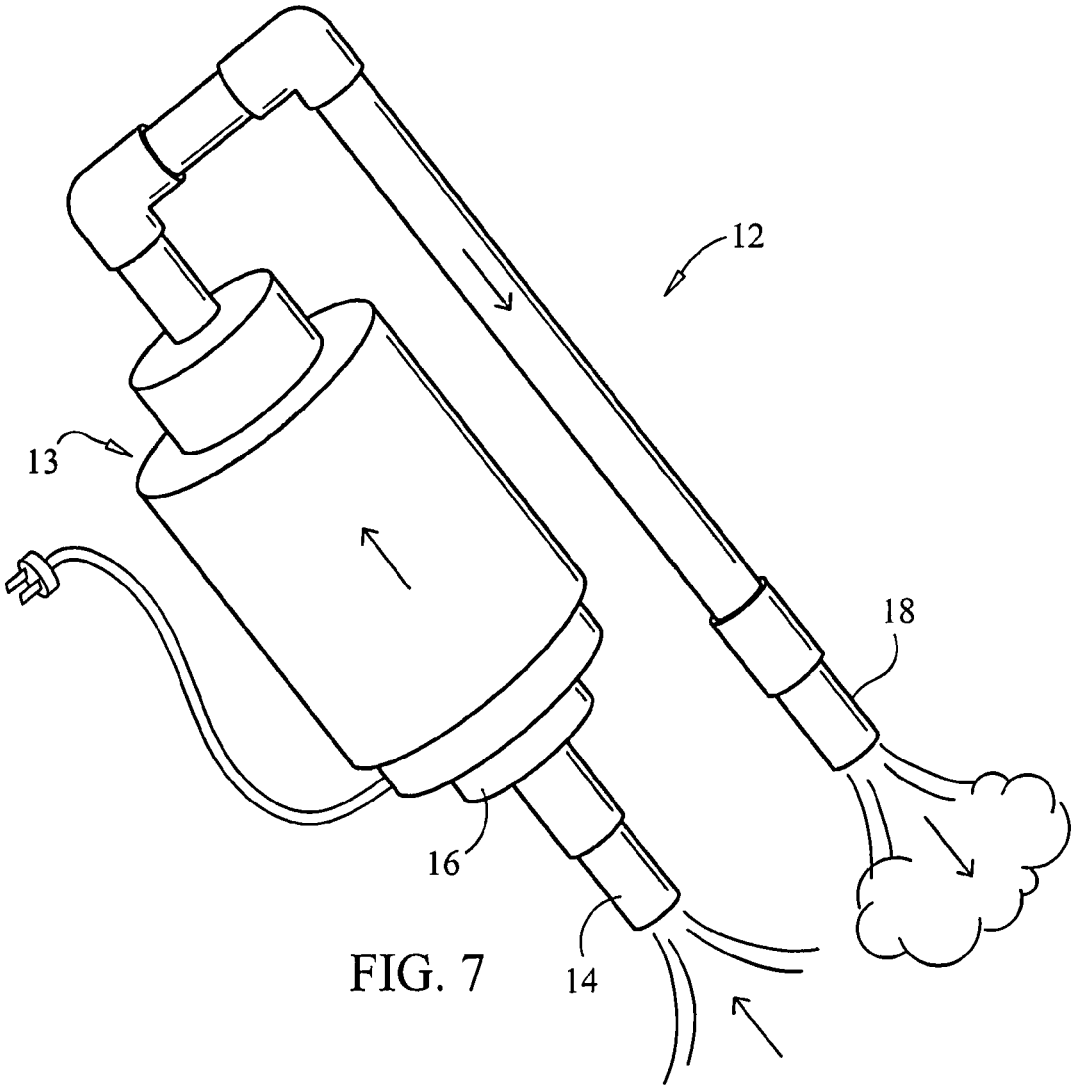
FIG. 7 is a perspective view of a motor driven vacuum option for the hookah accessory in accordance with the instant invention.
Figure 8:
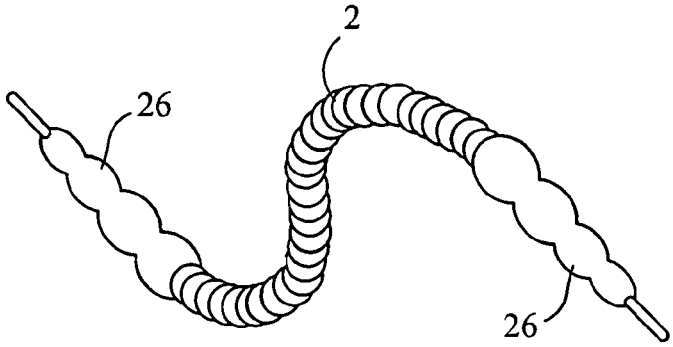
FIG. 8 is a perspective view of a hose and, or hose tip of the preferred embodiment of the hookah accessory in accordance with the instant invention.

The instant invention 10 may also include hoses adapted for use with a plurality of hookahs 1 and the hookah accessory 10. With reference to FIG. 7, the preferred hose 2 has a tapered end or tip 26 having gripping ridges for creating an airtight or substantially airtight seal when inserted in a port 14, 18. To start the hookah 1, the hose 2 or hose tip 3 is inserted in the vacuum port 14, which connects the power source to the vacuum 12 and, or vacuum motor 13 in the preferred embodiment. In the alternative embodiment, the power switch 22 must be actuated before or after inserting the hose 2 or hose tip 3 in the vacuum port 14. In the preferred embodiment, the vacuum motor 13 speed is constant and preset to a desired suction level based on the value of the vacuum resistor 35. In the preferred embodiment, to use the hookah accessory 10 for cleaning a hose 2 or hookah 2 the hose 2 is inserted in the air pressure port 18, which connects the power source to the vacuum 12 and, or vacuum motor 13, providing an instant source of air. In the alternative embodiment, the power switch 22 must be actuated before or after inserting the hose 2 or hose tip 3 in the air pressure port 18. In the preferred embodiment, the vacuum motor 13 speed is constant and preset to a desired air pressure level based on the value of the air pressure resistor 39. In the alternative embodiment, the rheostat 22 is used to adjust the motor 13 speed and hence the suction and air pressure forces.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A water pipe accessory device for igniting tobacco loaded into the hookah and cleaning one or more hoses used with the hookah, said device comprising:

a housing enclosure;

a vacuum, at least partially stored in and secured to said housing enclosure, for providing a suction force at one end and air pressure force at a return end;

a vacuum port accessible from said housing and in fluid/pneumatic communication with said vacuum suction force for inserting a hose to tap and direct the suction force generated by said vacuum;

an air output port accessible from said housing and in fluid/pneumatic communication with a return line of said vacuum for inserting a hose to tap and direct the air pressure force generated by said vacuum and accessed from said vacuum return line; and heating means for heating a heating agent used in a hookah to heat a selected tobacco product, wherein said heating means comprises:

an oven having a burner assembly for heating a selected tobacco pre-heating agent, said pre-heating agent comprising charcoal.

2. A device as recited in claim 1, further comprising a motor electrically and mechanically communicated with said vacuum.

3. A device as recited in claim 1, further comprising at least one hose adapted for insertion into at least one said port in a manner that at least substantially creates an airtight seal.

4. A device as recited in claim 1, wherein said heating means comprises:

an oven having a burner assembly for heating a selected tobacco pre-heating agent, said burner assembly comprising a top plate and underlying electrical coil.

5. A device as recited in claim 1, further comprising:

means for adjusting the power of the suction force generated by said vacuum and made available from said vacuum port.

6. A device as recited in claim 1, further comprising:

means for providing and removing electrical power to said vacuum.

7. A device as recited in claim 4, further comprising:

means for thermally insulating said oven.

8. A device as recited in claim 4, further comprising:

a timer in electrical communication with said burner assembly for removing power from said burner assembly according to a selected setting.

9. A device as recited in claim 4, further comprising:

a basket adapted for insertion into said oven on said top plate and for holding a selected heating agent, such as charcoal, said basket comprising a high heat thermo resistant material amenable to exposure to high heat without failure.

10. A device as recited in claim 5, wherein said means for adjusting the power of the suction and air pressure forces comprises a rheostat electrically communicated with said motor.

11. A device as recited in claim 5, wherein said means for adjusting the power of the suction and air pressure forces comprises:

a first electrical resistor and first switch in electrical communication with said motor to provide a first motor speed; and a second electrical resistor and second switch in electrical communication with said motor to provide a second motor speed, said first and second electrical resistors having different values so said first motor speed and second motor speed are different for setting the suction and air pressure forces.

12. A device as recited in claim 6, wherein said means for providing and removing power provides DC power.

13. A device as recited in claim 6, wherein said means for providing and removing power provides AC power.

14. A device as recited in claim 6, further comprising an electrical fuse in electrical communication with said means for providing and removing power.

15. A device as recited in claim 6, wherein said means for providing and removing power comprises an automatic switch that is triggered to an on position when a hose is inserted in said vacuum port or said air pressure port and to an off position when the hose is removed from said vacuum port or said air pressure port.

16. A device as recited in claim 6, wherein said means for providing and removing power comprises:

a first automatic switch at least partially disposed in said vacuum port that is triggered to an on position when a hose is inserted in said vacuum port and to an off positioned when removed; and a second automatic switch at least partially disposed in said air pressure port that is triggered to an on position when a hose is inserted in said air pressure port and to an off positioned when removed.

17. A device as recited in claim 16, further comprising:

means for adjusting the power of the suction force generated by said vacuum and made available from said vacuum port.

18. A device as recited in claim 17, wherein said means for adjusting the power of the suction and air pressure forces comprises:

a first electrical resistor in electrical communication with said motor and said first automatic switch to provide a first motor speed for a set suction force; and a second electrical resistor in electrical communication with said motor and said second automatic switch to provide a second motor speed for a set air pressure force, said first and second electrical resistors having different values.

* * * * *